United States Patent [19]

Mizuno et al.

[11] 4,388,047

[45] Jun. 14, 1983

[54] SOLENOID-OPERATED PUMP

[75] Inventors: Akira Mizuno; Shigeo Suzuki, both of Fukuroi, Japan

[73] Assignee: Shizuoka Seiki Co., Ltd., Fukuroi, Japan

[21] Appl. No.: 218,381

[22] Filed: Dec. 19, 1980

[30] Foreign Application Priority Data

Dec. 22, 1979 [JP] Japan ..... 54-167205

[51] Int. Cl.[3] ..... F04B 49/02; G05D 7/01

[52] U.S. Cl. ..... 417/299; 417/417; 137/115; 137/197

[58] Field of Search ..... 137/197, 199, 508, 115, 137/117; 417/540, 417, 299, 308, 302, 303

[56] References Cited

U.S. PATENT DOCUMENTS 3,692,038 9/1972 Hansen et al. ..... 417/299

3,816,030 6/1974 Strauff ..... 417/299

4,269,572 5/1981 Nozawa et al. ..... 417/417

*Primary Examiner*—Richard E. Gluck

*Assistant Examiner*—Peter M. Cuomo

*Attorney, Agent, or Firm*—Flynn, Thiel, Boutell & Tanis

[57] ABSTRACT

A solenoid-operated pump for discharging fluid from a tank through a fluid discharge passage in a pump body has a directional control valve disposed in the fluid discharge passage. The directional control valve is normally urged to direct fluid flow through a fluid drainage passage branched from the fluid discharge passage and adapted for connection to the tank. The fluid drainage passage includes a restrictor which produces a fluid-pressure build-up in response to a change in viscosity of the fluid flowing therethrough, that is, when air is no longer contained in the fluid. The directional control valve is responsive to such pressure build-up to direct the fluid to flow through the fluid discharge passage.

15 Claims, 7 Drawing Figures

45
400
408
402
401
404
411
413
414
403
61
405
A
410
409
412
406
407
20
2

SOLENOID-OPERATED PUMP

BACKGROUND OF THE INVENTION

1. Field of the Invention

The present invention relates to a solenoid-operated pump having an actuator such as a plunger electromagnetically movable back and forth, and more particularly to such a solenoid-operated pump for use in a burner in which pressurized fuel atomization is employed for normal fuel combustion.

2. Prior Art

Solenoid-operated pumps of the type described have an actuator reciprocable through, a small stroke at high speeds for effecting a pumping operation. With the small stroke of the actuator, the pump chamber undergoes a small change in volume. This has led to a disadvantage in that the pumping operation becomes inefficient when a great amount of air is trapped in the oil or fuel to be pumped especially at the time of starting operation of the pump or doing so after replenishing the fuel tank, since the trapped air is contractible in volume in the pump chamber. Accordingly, the fuel pressure becomes lower than the required degree in the fuel feeding system, thus preventing the fuel from getting atomized sufficiently at a spray nozzle with the result that incomplete or abnormal combustion will take place.

Such incomplete or abnormal combustion is disadvantageous especially in that it adversely affects the performance and service life of an oil-burning infrared-ray generator as shown in FIG. 1 of the accompanying drawings which the applicant has recently developed. More specifically, fuel supplied from a burner is combusted in a hollow furnace made of ceramic fiber to produce a high-temperature gas, which is introduced into a vertical red-heat tube made of metal network on the order of 70-mesh where the high-temperature gas is discharged outwardly through the meshes of the tube for generating infrared rays. When the incomplete or abnormal combustion takes place, smoke is given off in the furnace and becomes carbonized in the red-heat tube, resulting in formation of carbon which clogs the meshes of the red-heat tube. Accordingly, the red-heat tube is prevented from being heated uniformly and tends to be deformed due to undue combustion pressure, at which time the tube might be cracked to thereby allow leakage of combustion gas.

Attempts have been known to remove air from fuel in the fuel-feeding system.

One such proposal is directed to a manually-operated directional control valve disposed in an outlet passage and actuatable by the operator at the time of starting operation of the infrared ray generator or as desired to return discharged fuel back into the fuel tank until air is no longer contained in the fuel. After removal of air from the fuel, the valve is actuated again to connect the outlet passage to the spray nozzle. This arrangement is troublesome since the operator is required to actuate the valve each time it is necessary to do so. Sometimes, the operator may forget to operate the valve or may reinstate the valve before the air is completely removed from the fuel.

An attempt for an automatic air-bleeding operation would be to dispose a pressure switch in the fuel outlet passage, and branch off a portion of the outlet passage which is located downstream of the pressure switch into two passages leading respectively to the spray nozzle and the fuel tank and which contain corresponding solenoid valves. If the pressure in the outlet passage is below a predetermined degree, the solenoid valve in the passage leading to the spray nozzle would be closed and the other solenoid valve in the passage leading to the fuel tank would be opened, thereby allowing air-laden fuel to be returned to the fuel tank until air is removed from the fuel. If the outlet passage is pressurized above the predetermined degree, the solenoid valve in the passage to the spray nozzle would be opened with the solenoid valve in the passage to the fuel tank being closed, so that fuel can be introduced into the spray nozzle. However, such a structure would require separate pressure switches and solenoid valves which are expensive, large in size and need an increased expenditure of time and labor in the assembling operation.

SUMMARY OF THE INVENTION

A valve is disposed in an outlet passage in a pump body or in a casing coupled to the pump body, the valve being actuatable in response to a fuel pressure in the outlet passage. When such a fuel pressure is below a predetermined degree, the valve allows the outlet passage to be held in fluid communication with a fuel tank until air is removed from fuel from the fuel tank. Conversely, when the fuel pressure exceeds the predetermined degree, the valve is shifted to provide fluid communication between the outlet passage and the spray nozzle, and at the same time fuel flow back to the fuel tank is blocked.

It is an object of the present invention to provide a solenoid-operated pump having an automatic air-bleeder mechanism which is small in size and inexpensive to construct.

Another object of the present invention is to provide such a solenoid-operated pump that is simple in structure and reliable in the air bleeding operation.

Still another object of the present invention is to provide a solenoid-operated pump having an automatic air-bleeder mechanism which can be detachably mounted on the pump body.

The above and other objects, features and advantages of the present invention will become apparent from the following description when taken in conjunction with the accompanying drawings which show preferred embodiments of the present invention by way of illustrative examples.

DETAILED DESCRIPTION

Figure 1:
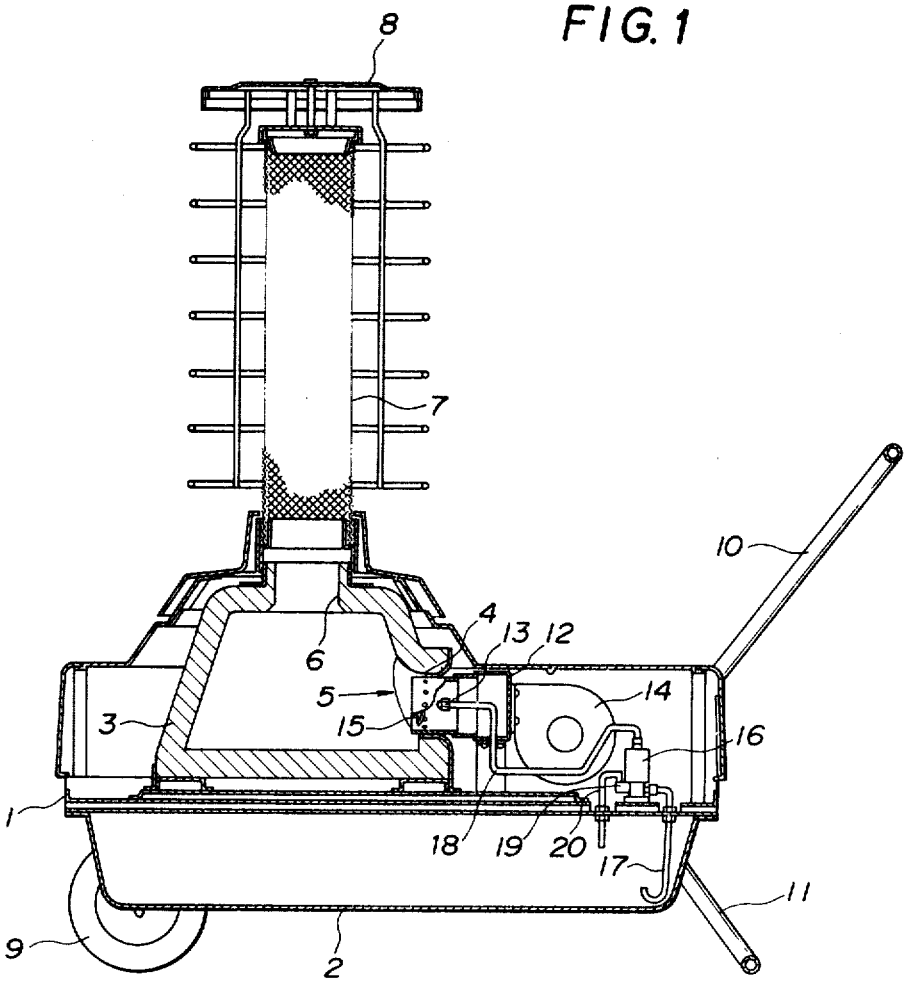
FIG. 1 is a vertical cross-sectional view of an oil-burning infrared ray generator which includes a solenoid-operated pump according to the present invention.

FIG. 1 shows an oil-burning infrared ray generator including a solenoid-operated pump according to the present invention. The infrared ray generator comprises a body or frame 1 having in its lower part a fuel tank 2 on which is mounted a furnace 3 substantially in the shape of a truncated cone. The furnace 3 has an intake opening 4 in which an oil burner 5 is disposed, and an exhaust opening 6 to which is connected a vertical red-heat tube 7 supported in position by a retainer 8. The frame 1 has a roller 9 rotatably mounted on the fuel tank 2 at a front end portion thereof, a handle 10 extending upwardly and rearwardly from the frame 1, and a support leg 11 extending downwardly and rearwardly from the fuel tank 2 at a rear end portion thereof. Therefore, the generator can be moved around by lifting and pushing the handle 10.

The oil burner 5 comprises a draft tube 12 fitted in the intake opening 4, a nozzle 13 disposed centrally within the tube 12 and directed toward the furnace 3 for atomizing fuel, a fan 14 having a discharge outlet connected to a rear end of the tube 12 for forcibly supplying air into the tube 12, a stabilizer 15 attached to a front end of the tube 12 for uniformly spreading flame into the furnace 3, and a discharging electrode (not shown) for igniting air-fuel mixture.

A solenoid-operated pump 16 according to the present invention is mounted on the fuel tank 2 and has an inlet pipe 17 extending into the fuel tank 2 and an outlet pipe 18 connected to the nozzle 13. The solenoid-operated pump 16 contains a directional control valve 19 with an air-bleeder mechanism (described later) which is coupled to a return pipe 20 communicating with the fuel tank 2.

Figure 2:
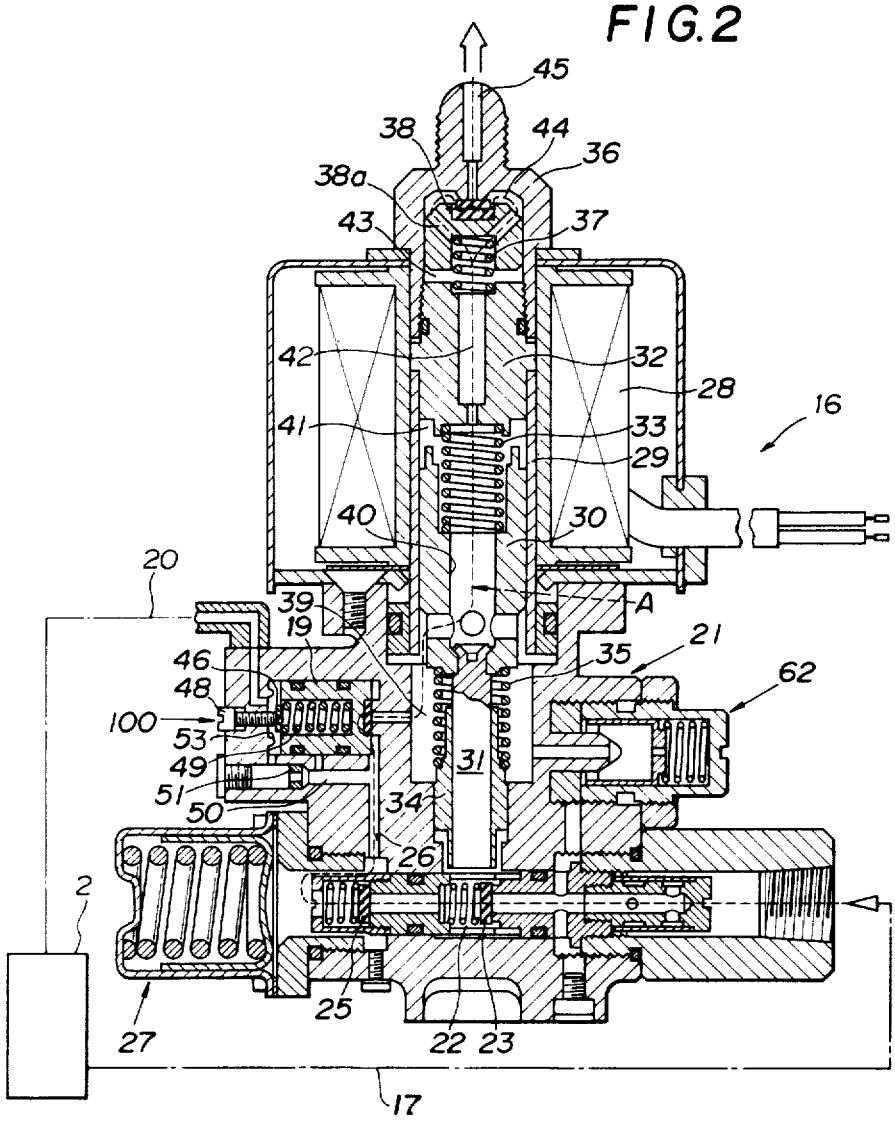
FIG. 2 is an enlarged vertical cross-sectional view of a solenoid-operated pump according to a first embodiment of the present invention.

As shown in FIG. 2, the solenoid-operated pump 16 includes a pump body 21 having in its lower part a pump chamber 22 which communicates at one end thereof with the fuel tank 2 via an inlet valve 23 and at the other end with an outlet passage 26 via an outlet valve 25. An accumulator 27 is mounted on the pump body 21 adjacent to the outlet valve 25 for reducing pulsations or an uneven flow of fuel from the outlet valve 25. The pump 16 also includes a solenoid 28 mounted on the pump body 21 and having an axial plunger 30 slidably disposed in a guide sleeve 29 and movable up and down in response to energization and de-energization of the solenoid 28. A piston 31 is connected to and extends downwardly from the plunger 30 so as to be movable into and out of the pump chamber 22. The solenoid 28 also has a fixed rod 32 therein and an upper compression coil spring 33 acting between the fixed rod 32 and the plunger 30 to urge the latter downwardly. A lower compression coil spring 35 is disposed between the plunger 30 and a cylindrical insert 34 loosely fitted over the piston 31 and mounted in the pump body 21. An outlet coupling 36 is fixed to the rod 32 and has a portion projecting into the coil 28. The coupling 36 houses therein a solenoid valve 38 supported by a coil spring 37 on the fixed rod 32 and actuatable in response to energization of the solenoid coil 28 for allowing fuel to pass therethrough. A fuel flow passage A through the pump 16 is constituted by the outlet passage 26, a chamber 39 in which the piston 31 is disposed, a hole 40 in the plunger 30, a chamber 41 between the plunger 30 and the fixed rod 32, a bore 42 in the fixed rod 32, a chamber 43 between the fixed rod 32 and the solenoid valve 38, a hole 38*a* in the valve 38, a chamber 44 in the outlet coupling 36 on the valve 38, and an outlet hole 45 in the coupling 36. The outlet coupling 36 is connected to the outlet pipe 18 (FIG. 1) which is coupled to the nozzle 13.

The solenoid-operated pump 16 shown in FIG. 2 includes an automatic air-bleeder mechanism 100 comprising the directional control valve 19 for opening and closing the passage 26, the valve 19 being normally urged in a direction to close the passage 26 by a valve spring 49 supported by a spring seat 46 on an adjustment screw 48. An air-bleeder passage 50 is branched off from the passage 26 at a position upstream of the valve 19. The air-bleeder passage 50 communicates via a restrictor 51 and a passage behind the valve 19 with the return pipe 20 which is connected to the fuel tank 2 as described above. There is an annular ridge 53 projecting from a portion of the pump body 21 behind the valve 19, which ridge 53 can coact with the valve 19 to close the return pipe 20. Designated at 62 is a pressure adjuster.

Before the solenoid-operated pump 16 is actuated, the passage 26 is closed by the directional control valve 19 since the pressure in the passage 26 upstream the valve 19 is low. When the solenoid coil 28 is energized by an AC current as rectified through half-wave rectification, the coil 28 produces an intermittent magnetic force which enables the plunger 30 and hence the piston 31 connected thereto to reciprocate up and down. The piston 31 is moved into and out of the pump chamber 22 to change the volume of the pump chamber 22, to thereby alternately open and close the inlet and outlet valves 23, 25. Liquid fuel is thus pumped from the fuel tank 2 through the inlet valve 23, the chamber 22, and the outlet valve 25 into the passage 26. If air is trapped in the fuel as when the pump 16 starts being actuated, the pressure in the passage 26 is still low and the valve 19 remains closed, causing air-laden fuel to be discharged through the return pipe 20 into the fuel tank 2. As almost all air is forced out of the fuel, the fuel pressure in the passages 26, 50 upstream of the restrictor 51 is increased due to fuel viscosity until the valve 19 is shifted leftwards as shown in FIG. 2 against the force from the spring 49, thereby opening the passage 26 and closing the passage 50 when the valve 19 is held at a rear face thereof against the annular ridge 53. Since the solenoid valve 38 is actuated so as to be in an open position as long as the coil 28 is energized, that is, the pump 16 is operated, fuel is allowed to flow via the directional control valve 19 through the flow passage A toward the nozzle 13 in the oil burner 5. When the solenoid coil 28 is de-energized to stop operation of the pump 16, the plunger 30 stops operating and the valve 19 is forced by the spring 49 into its closed position. At the same time, the solenoid valve 38 is returned to its closed position to block passage of fuel therethrough.

While in the illustrated embodiment of FIG. 2 air is discharged through the pipe 20 connected to the tank 2, the air-bleeder passage 50 may be vented directly to atmosphere without being connected to the fuel tank 2 provided the portion of the passage 50 which is downstream of the restrictor 51 were extended up to a point at a required height.

Figure 3:
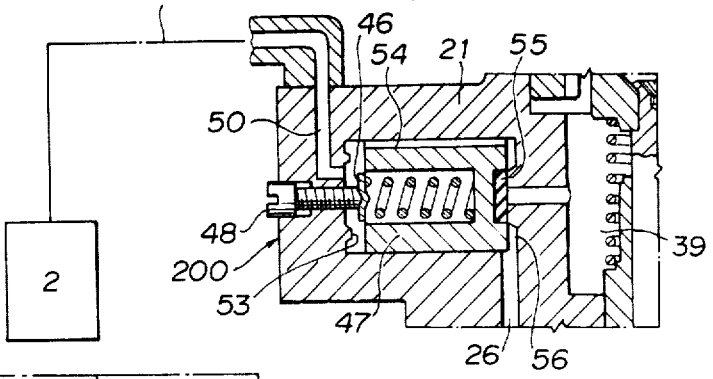
FIG. 3 is an enlarged cross-sectional view of an air-bleeder mechanism according to a second embodiment.

According to a second embodiment shown in FIG. 3, an air-bleeder mechanism 200 has a slot 54 formed axially in the periphery of the directional control valve 47, the slot 54 serving as a restrictor. The valve 47 is shown as being in a closed position in which the valve 47 is held against an annular valve seat 55 projecting from a portion of the valve body 21. The passage 26 communicates with a valve chamber 56 disposed in front of the valve seat 55 and capable of fluid communication with the air-bleeder passage 50 connected to the pipe 20 when the valve 47 is in its closed position. When the pressure in the passage 26 upstream of the valve 47 is below a predetermined degree, the valve 47 is in its closed position as shown, allowing air to be discharged from the passage 26 via the valve chamber 56, the slot 54, and the passage 56 into the tank 2 through the pipe 20.

Figure 4:
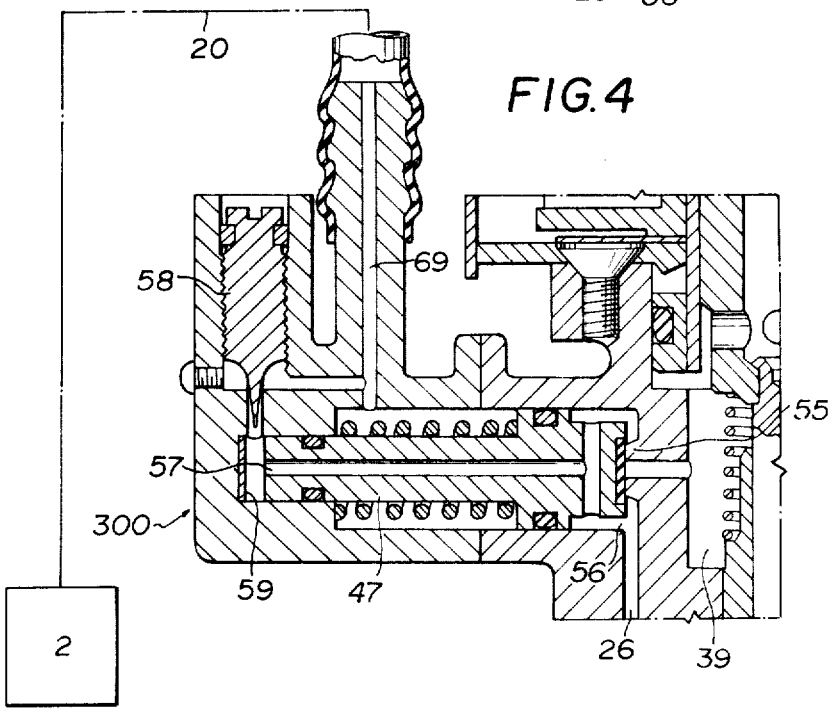
FIG. 4 is an enlarged cross-sectional view of an air-bleeder mechanism according to a third embodiment.

FIG. 4 shows an air-bleeder mechanism 300 according to a third embodiment, in which the directional control valve 47 has an axial air-discharge hole 57 which communicates at one end with the valve chamber 56 leading to the passage 26 and at the other end with another valve chamber 59 which is held in fluid communication through a restrictor or needle valve 58 with a passage 69 connected via the pipe 20 to the fuel tank 2. When the valve 47 is in the closed position abutting against the valve seat 55 because of a low pressure in the passage 26, air trapped in the passage 26 is discharged through the valve chamber 56, the hole 57, the valve chamber 59, the restrictor 58, the passage 60, and the pipe 20 into the fuel tank 2.

Figure 5:
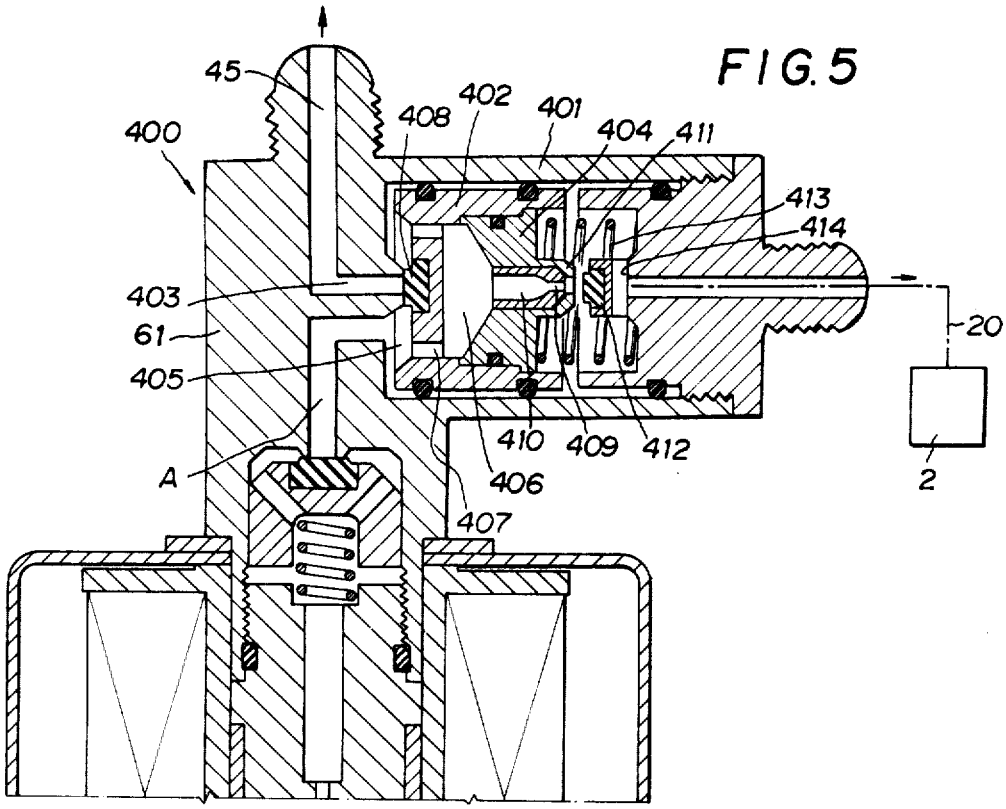
FIG. 5 is an enlarged cross-sectional view of an air-bleeder mechanism according to a fourth embodiment.

According to a fourth embodiment shown in FIG. 5, an air-bleeder mechanism 400 is separate from the pump body and is integral with an outlet coupling 61 threadedly mounted on the pump body. The air-bleeder mechanism 400 comprises a casing 401 in which is slidably disposed a slide 402 adjacent to an outlet port 403 communicating with the outlet passage 45 leading to the nozzle 13 (FIG. 1) via the pipe 18. A partition member 404 is fitted in the slide 402. A first valve chamber 405 is defined between the port 403 and the slide 402, and a second valve chamber 406 which is smaller in diameter than the first chamber 405 is defined between an end wall of the slide 402 and the partition member 404, the valve chambers 405, 406 being held in fluid communication with each other through holes 407. The end wall of the slide 402 supports thereon a first valve 408 having a damper in confronting relation to the port 403. The partition member 404 has an axial passage 410 including a restrictor 409 defined in an axial projection 411 extending as a valve seat toward a second valve 412 having a damper mounted in the casing 401. The partition member 404 is normally urged leftwards toward the end wall of the slide 402 by a compression coil spring 413 disposed in the casing 401, causing the first valve 408 to close the port 403. When the partition member 404 is thus urged leftwards, the projection 411 is located away from the second valve 412. allowing the passage 410 to communicate with the air-bleeder passage 20 via a slot 414 behind the second valve 412.

Liquid fuel containing air flows from the passage A via the first valve chamber 405 and the holes 407 into the second valve chamber 406. As the air-laden fuel is low in pressure, the slide 402 and hence the first valve 408 remain displaced leftwards closing the port 403. Thus, the fuel flows through the restrictor 409 into the pipe 20.

When air is no longer contained in the fuel, the fuel pressure builds up upstream of the restrictor 409 due to fuel viscosity. Since the first valve chamber 405 is of a larger diameter than that of the second valve chamber 406, pressurization in the first chamber 405 is greater than that in the second chamber 406, causing the slide 402 to be shifted rightwards until the projection 411 is held against the second valve 412 to close the passage 410. Simultaneously, the first valve 408 is displaced away from the port 403, whereupon the fuel is allowed to flow from the passage A via the port 403 into the passage 45. With the arrangement shown in FIG. 5, the air-bleeder mechanism 400 can be constructed independently of the pump proper and can easily be attached to or detached from the latter.

Figure 6:
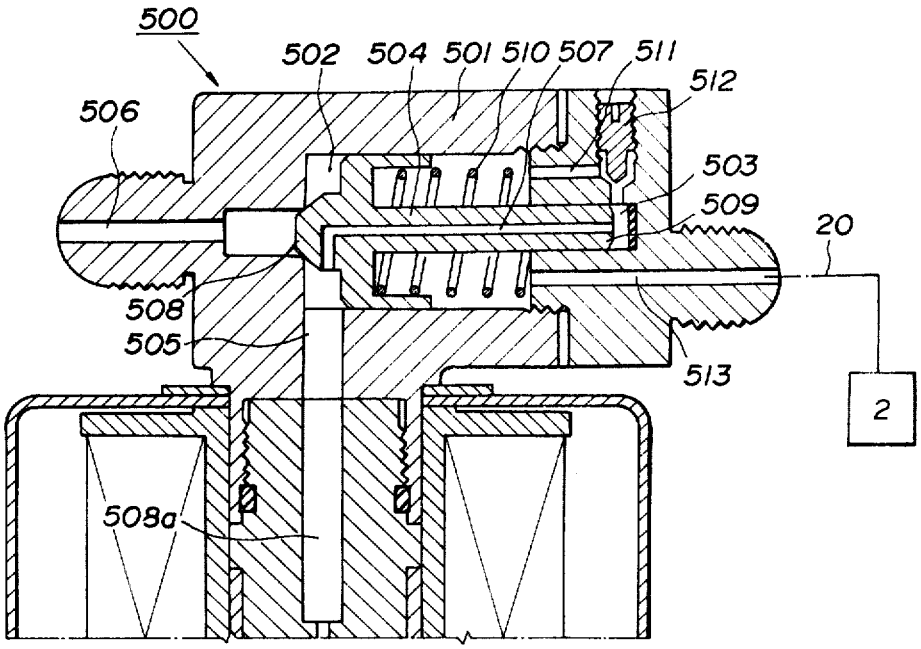
FIG. 6 is an enlarged cross-sectional view of an air-bleeder mechanism according to a fifth embodiment.

As illustrated in FIG. 6, an air-bleeder mechanism 500 according to a fifth embodiment comprises a valve body 501 having first and second valve chambers 502, 503 communicating with each other, the first chamber 502 being larger in diameter than the second chamber 503. A plunger 504 is axially movably disposed in the chamber 502, 503. An inlet port 505 which is defined in the valve body 501 communicates with the first chamber 502 at an end thereof which is remote from the second chamber 503, the inlet port 505 communicating with an outlet passage **508*a* in the pump body. The valve body 501 also has an outlet port 506 communicating with the first chamber 502 in coaxial relation therewith. The plunger 504 has an axial passage 507 extending substantially all the way therethrough and communicating at one end thereof with the first chamber 502 at all times. The plunger 504 also has on one end thereof a first valve portion 508 for opening and closing the outlet port 506 and on the other end a second valve portion 509 for opening and closing the plunger passage 507 at the second chamber 503 through coaction with a wall which defines the second chamber 503. Thus, the plunger passage 507 communicates with the second chamber 503 only when the second valve 509 is displaced leftwards out of the second chamber 503. The plunger 504 is axially urged by a compression coil spring 510 disposed in the first chamber 502 remotely from the outlet port 506 normally in a direction to cause the first valve portion 508 to close the outlet passage 506 and to cause the second valve portion 509 to open the plunger passage 507. The second chamber 503 communicates with the first chamber 502 also through a return passage 511 having an adjustable restrictor 512. The valve body 501 has a return port 513 communicating between the first chamber 502 at an end thereof remote from the outlet port 506 and the return pipe 20 connected to the fuel tank 2**.

Fuel discharged through the outlet passage **508*a* is introduced into the first chamber 502 via the inlet port 505. When the pressure of fuel is low owing to air trapped therein, the plunger 504 remains shifted leftwards under the force of the spring 510 to close the outlet port 506 with the first valve portion 508 and to provide communication between the plunger passage 507 and the second valve chamber 503. The air-laden fuel thus flows from the first valve chamber 502 through the passage 507, the second valve chamber 503, the restrictor 512, the return passage 511, the first valve chamber 502, and the return port 513 into the pipe 20. Since viscosity of the air-laden fuel is low, the fuel can pass through the restrictor 512** without being resisted thereby and hence without causing a pressure build-up.

As the air-laden fuel is returned to the fuel tank 2 and fuel discharged through the outlet passage **508*a* contains almost no air, the viscosity of such fuel is increased to the point where the restrictor 512 creates resistance to passage of fuel therethrough, whereupon there is produced a pressure build-up upstream of the restrictor 512, that is, in the first and second valve chambers 502, 503. Since the first valve chamber 502 is larger in diameter than the second valve chamber 503, the first valve chamber 502 is subjected to greater pressurization, causing the plunger 504 to move rightwards to open the outlet port 506. At the same time, the second valve portion 509 abuts against the wall of the second valve chamber 503 to close the passage 507. Accordingly, all of the fuel flowing from the inlet port 505 is directed through the outlet port 506 to the spray nozzle 13 (FIG. 1**).

Figure 7:
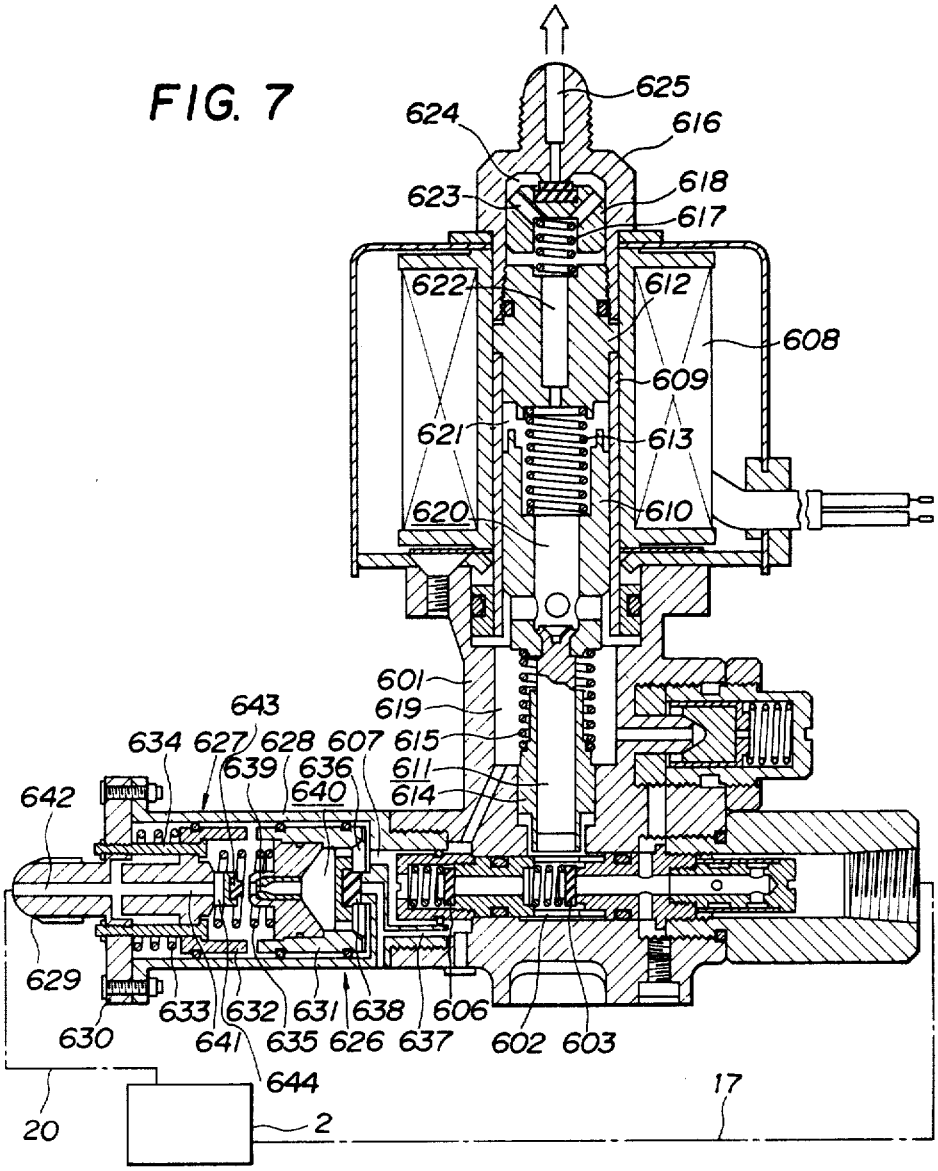
FIG. 7 is an enlarged vertical cross-sectional view of a solenoid-operated pump according to a sixth embodiment of the present invention.

FIG. 7 shows a solenoid-operated pump according to a sixth embodiment of the present invention. The pump comprises a pump body 601 having a pump chamber 602 in a lower portion thereof which communicates at one end with the fuel tank 2 via an inlet valve 603 and the inlet pipe 17 and at the other end with an outlet port 607 via an outlet valve 606. The pump also includes a solenoid coil 608 disposed upwardly of the pump chamber 602 and having an inner guide case or sleeve 609 in which there is fitted a plunger 610 movable up and down in response to energization and de-energization of the coil 608. A piston 611 is connected to the plunger 610 at a lower end thereof and movable into and out of the pump chamber 602. The plunger 610 is normally urged downwardly by an upper compression coil spring 613 disposed between the plunger 610 and a fixed rod 612 mounted in the coil 608 upwardly of the plunger 610. A cylindrical insert 614 is slidably fitted over the piston 611 and is normally urged downwardly by a lower compression coil spring 615 acting between the plunger 610 and the insert 614. An inlet coupling 616 is threadedly secured to the fixed rod 612 and houses therein a solenoid valve 618 supported by a coil spring 617 on the fixed rod 612 and actuatable in response to energization of the solenoid coil 608 for allowing fuel to pass therethrough. Fuel is normally caused to flow from the outlet port 607 through a chamber 619 in the pump body 601 in which the piston 611 is disposed, a hole 620 in the plunger 610, a chamber 621 in the guide sleeve 609 between the fixed rod 612 and the plunger 610, a hole 622 in the fixed rod 612, a hole 623 in the solenoid valve 618, a chamber 624 in the outlet coupling 616, and thence through an outlet hole 625 which communicates with the burner nozzle 13 (FIG. 1) via the outlet pipe 18.

An automatic air-bleeder mechanism 626 is mounted on the pump body 601 at a position adjacent to the outlet port 606 and comprises an accumulator 627 having a cylinder 628 which is threadedly attached at one end thereof to the pump body 601. The cylinder 628 has on the other end thereof a cover 630 bolted thereto and including a coupling 629. The cylinder 628 houses therein a pressure-sensitive piston 631 on the pump-body side and an accumulator piston 632 on the cover side, the pistons 631, 632 being axially movable with suitable sealing members disposed therearound. The accumulator piston 632 is normally urged rightwards, that is, toward the pressure-sensitive piston 631 by a compression coil spring 633 acting between the cover 630 and the piston 632, there being a stopper 634 which limits rightward movement of the piston 632. The pistons 631, 632 are normally urged away from each other by a compression coil spring 635 disposed therebetwen, the spring 635 being of a smaller resiliency than that of the spring 633. The pressure-sensitive piston 631 has a chamber 636 communicating with the outlet port 607, there being a passage 637 communicating between the chamber 619 and the chamber 636. The piston 631 includes therein a fuel valve 638 for opening and closing the passage 637 at its end in the chamber 636. The piston 631 also has an air-bleeder passage 640 communicating with the chamber 636 and having a restrictor 639. The accumulator piston 632 and the cover 630 have air-bleeder passages 641, 642, respectively, held in fluid communication with each other. The piston 632 has an air-bleeder valve 643 for opening and closing the air-bleeder passage 640 in the pressure-sensitive piston 631. The coupling 629 is connected through the return pipe 20 to the fuel tank 2.

When the solenoid 608 is energized intermittently, the plunger 610 and hence the piston 611 are moved up and down to increase and reduce the volume of the pump chamber 602, causing the inlet and outlet valve 603, 606 to be opened and closed alternately for thereby pumping fuel out of the fuel tank 2 and feeding it through the outlet valve 606.

When air-laden fuel is introduced into the outlet port 607, the pressure-sensitive piston 631 remains displaced rightwards away from the accumulator piston 632 under the resiliency of the spring 635 since the pressure of such fuel is not sufficiently high to shift the piston 631. Accordingly, the passage 637 is closed by the fuel valve 638 and the air-bleeder valve 643 is not engaged by the piston 631. The chamber 636 is thus allowed to communicate via the air-bleeder passage 640, a space in the cylinder 628 between the pistons 631, 632, and a slot 644 behind the valve 643 with the passages 641, 642, whereupon the air-laden fuel flows back into the fuel tank 2. As air is substantially removed from fuel, fuel pressure is increased upstream of the restrictor 639 due to viscosity thereof, whereupon the chamber 636 is pressurized to an extent that causes the piston 631 to be shifted leftwards against the force of the spring 635 until the piston 631 abuts against the piston 632. The fuel valve 638 is now in its open position, and the air-bleeder valve 643 closes the passage 640. Thus, the chamber 636 communicates with the passage 637 to allow the fuel to flow from the outlet port 607 into the chamber 619 and to be fed all the way to the nozzle 13.

Pulsations in fuel flow from the valve 606 are taken up to provide an even flow when the pistons 631, 632 move in unison against and under the resiliency of the spring 633 to change the volume of the chamber 636.

While in the illustrated embodiment the air-bleeder mechanism 626 is disposed immediately downstream of the outlet port 606, it may be positioned anywhere downstream of the outlet port 606. With this arrangement, the air-bleeder mechanism 626 which is combined with the accumulator can easily be detachably mounted on the pump body 601. Accordingly, no substantial modification of the pump body 601 is necessary. Furthermore, the pump body 601 can be rendered simple in structure and small in size as the air-bleeder mechanism 626 is separately constructed.

Althrough certain preferred embodiments have been shown and described in detail, it should be understood that many changes and modifications may be made therein without departing from the scope of the appended claims. For Example, the piston and plunger type pump described in the above may be replaced by a diaphram type pump.

What is claimed is:

1. A solenoid-operated group, comprising:

a pump body having a first passage extending therethrough, said first passage having a closeable port between the ends thereof:

a solenoid-operated actuator mounted in said pump body for pumping fluid through said first passage, said actuator being located upstream from said port;

fluid directing means comprising a directional control valve mounted on said pump body adjacent to said port, said directional control valve having a valve casing and a valve slide mounted for sliding movement in said valve casing, said valve slide having a first end wall and a second end wall at opposite ends thereof, said first end wall being disposed in opposing relationship to said port, said second end wall being disposed in opposing relationship to an end wall of said valve casing, a first valve member supported on said first end wall of said valve slide and adapted to seat against and thereby close said port, said fluid directing means having a second passage branched from said first passage at a location upstream of said port, a second valve member in said second passage, said second valve member being mounted on said end wall of said casing, said valve slide having a valve element on said second end wall thereof and disposed in opposing relation to said second valve member and adapted to seat against said second valve member to close said second passage;

means for normally positioning said valve slide in a first position in which said first valve member seats against and closes said port so that said first passage is blocked and said valve element is spaced from said second valve member so that said second passage is open;

and means in said second passage for producing a change in the pressure of the fluid flowing therethrough in response to a change of the viscosity of the fluid and shifting said valve slide to a second position in which said first valve member is spaced from said port so that said first passage is open and said valve element is seated against said second valve member so that said second passage is blocked.

2. A solenoid-operated pump according to claim 1, in which said means for producing a change in the pressure of the fluid comprises a restrictor located in said second passage and effective to produce the pressure change at a location upstream of said fluid directing means.

3. A solenoid-operated pump according to claim 2, in which said restrictor comprises an adjustable needle valve.

4. A solenoid-operated pump according to claim 1, in which said means for normally positioning said valve slide in said first position comprises a coil spring normally resiliently urging said valve slide to said first position.

5. A solenoid-operated pump according to claim 4, including means for adjusting the resiliency of said coil spring.

6. A solenoid-operated pump according to claim 1, in which said second passage is disposed outside of said valve slide in bypassing relation thereto, and said second passage extends through said second valve member.

7. A solenoid-operated pump according to claim 1, in which said second fluid passage has a portion extending through said valve slide and said valve element.

8. a solenoid-operated pump according to claim 7, in which said valve casting and said valve slide define a first valve chamber located between said first end wall of said valve slide and said port and disposed around said first valve member and a second valve chamber disposed within said valve slide, said second valve chamber communicating with said first valve chamber and with an opening through said valve element so that said second valve chamber is part of said second passage, said first valve chamber being larger in diameter than said second valve chamber.

9. A solenoid-operated pump according to claim 1, in which said directional control valve is removably mounted on said pump body.

10. A solenoid-operated pump according to claim 1, including an accumulator coacting with said directional control valve to absorb pulsations in the fluid flowing through said first fluid passage.

11. A solenoid-operated pump for discharging fluid from a tank, comprising:

a pump body having a first fluid discharge passage extending therethrough and adapted to be connected to the tank, said first passage having a closeable port between the ends thereof;

a solenoid-operated actuator mounted in said pump body for pumping fluid from the tank through said first passage, said actuator being located upstream from said port;

fluid directing means comprising a directional control valve mounted on said pump body adjacent to said port, said directional control valve having a valve casing and a valve slide mounted for sliding movement in said valve casing, said valve slide having a first end wall and a second end wall at opposite ends thereof, said first end wall being disposed in opposing relationship to said port, said second end wall being disposed in opposing relationship to an end wall of said valve casing, a first valve member supported on said first end wall of said valve slide and adapted to seat against and thereby close said port, said fluid directing means having a second fluid drainage passage branched from said first passage at a location upstream of said port, a restrictor in said second passage for causing an increase in the pressure of the fluid in said first passage upstream from said port in response to a change in the property of the fluid flowing therethrough, a second valve member in said second passage, said second valve member being mounted on said end wall of said casing, said valve slide having a valve element on said second end wall thereof and disposed in oppposing relation to said second valve member and adapted to seat against said second valve member to close said second passage;

means for normally positioning said valve slide in a first position in which said first valve member seats against and closes said port so that said first passage is blocked and said valve element is spaced from said second valve member so that said second passage is open;

said restrictor being effective to increase the pressure of the fluid to shift said valve slide to a second position in which said first valve member is spaced from said port so that said first passage is open and said valve element is seated against said second valve member so that said second passage is blocked.

12. A solenoid-operated pump according to claim 11, in which said directional control valve is housed in said pump body.

13. A solenoid-operated pump according to claim 11, in which said directional control valve is detachably mounted on said pump body.

14. A solenoid-operated pump according to claim 11, in which said solenoid-operated actuator comprises an electromagnetic coil, a pump element reciprocable in response to energization of said coil to pump the fluid through the first passage, an outlet coupling mounted on said pump body and having the terminal portion of said first passage extending therethrough, an electromagnetically operable valve element disposed in said pump body for reciprocating movement in response to energization of said coil and adapted to close said terminal portion of said first passage when said electromagnetic coil is not energized and to open said terminal portion of said first passage when said electromagnetic coil is energized.

15. A solenoid-operated pump according to claim 14, in which said outlet coupling has a conduit extending therethrough defining said terminal portion of said first passage, said conduit having said port provided therein between its ends, said valve casing extending laterally from said port and having an internal cylindrical opening of larger size than said port and which extends away from said port and is closed at its opposite end by said end wall of said casing, said valve slide being disposed within said cylindrical opening for reciprocable movement between said first and second positions, said first end wall of said valve slide being spaced from said port when said valve slide is in said first position so that a first annular chamber is formed surrounding said port and said first valve member, said valve slide having an internal cavity of smaller diameter than said first chamber, first passage means extending from said first chamber to said cavity and second passage means extending from said cavity through said valve element whereby said first and second passage means and said cavity define a portion of said second passage, a coil spring disposed between said end wall of said valve casing and said second end wall for said valve slide for continuously urging said valve slide toward said port.

* * * * *